US009355801B2

(12) United States Patent
Hofsaess

(10) Patent No.: US 9,355,801 B2
(45) Date of Patent: May 31, 2016

(54) BIMETAL PART AND TEMPERATURE-DEPENDENT SWITCH EQUIPPED THEREWITH

(76) Inventor: Marcel P. Hofsaess, Sondershausen (DE)

( * ) Notice: Subject to any disclaimer, the term of this patent is extended or adjusted under 35 U.S.C. 154(b) by 437 days.

(21) Appl. No.: 13/311,142

(22) Filed: Dec. 5, 2011

(65) Prior Publication Data

US 2012/0126930 A1 May 24, 2012

Related U.S. Application Data

(63) Continuation of application No. PCT/EP2010/057824, filed on Jun. 4, 2010.

(30) Foreign Application Priority Data

Jun. 5, 2009 (DE) ..... 10 2009 025 221

(51) Int. Cl.
*H01H 37/52* (2006.01)
*H01H 37/54* (2006.01)
*H01H 1/26* (2006.01)

(52) U.S. Cl.
CPC ..... *H01H 37/54* (2013.01); *H01H 1/26* (2013.01); *H01H 2037/5463* (2013.01)

(58) Field of Classification Search
CPC .. H01H 37/54; H01H 1/26; H01H 2037/5463
USPC ..... 337/85, 89, 11, 362, 365, 379
See application file for complete search history.

(56) References Cited

U.S. PATENT DOCUMENTS

| | | | | |
|---|---|---|---|---|
| 1,668,973 | A * | 5/1928 | Mottlau | 337/365 |
| 2,249,837 | A | 7/1941 | Lee | |
| 2,286,053 | A * | 6/1942 | Bletz | 337/365 |
| 2,363,376 | A | 11/1944 | Woodman | |
| 2,624,819 | A * | 1/1953 | Andersen et al. | 337/367 |
| 2,701,475 | A * | 2/1955 | Readeker | 74/100.2 |
| 2,777,032 | A * | 1/1957 | Burch | 337/91 |
| 2,967,920 | A | 12/1958 | Harper, Jr. et al. | |
| 3,213,228 | A * | 10/1965 | Burch et al. | 200/407 |

(Continued)

FOREIGN PATENT DOCUMENTS

| | | |
|---|---|---|
| CA | 1053204 | 4/1979 |
| DE | 1 998 672 | 7/1968 |

(Continued)

OTHER PUBLICATIONS

ISA/EP; English language translation of International Preliminary Report on Patentability (Chapter 1); issued by WIPO Dec. 16, 2011; 9 pages.

(Continued)

*Primary Examiner* — Anatoly Vortman
(74) *Attorney, Agent, or Firm* — Harness, Dickey & Pierce, P.L.C.

(57) ABSTRACT

A bimetal part (10) for use as an active switching element in a temperature-dependent switch has at least one inner region (13) and an outer region (12) surrounding the at least one inner region (13), the inner region (13) and the outer region (12) being formed such that in certain portions they are in one piece with one another and in certain portions they are mechanically separated from one another and being stamped in opposite directions, and at least one contact area (21) being provided on the inner region (13).

26 Claims, 6 Drawing Sheets

(56) References Cited

U.S. PATENT DOCUMENTS

| | | | | | |
|---|---|---|---|---|---|
| 3,872,417 | A | * | 3/1975 | Hufschmid | 337/365 |
| 4,118,610 | A | * | 10/1978 | Purssell et al. | 200/407 |
| 4,145,587 | A | * | 3/1979 | Purssell | 200/407 |
| 5,184,269 | A | * | 2/1993 | Shimada et al. | 361/24 |
| 5,497,286 | A | * | 3/1996 | Shimada et al. | 361/105 |
| 5,760,672 | A | * | 6/1998 | Wang | 337/79 |
| 5,790,010 | A | * | 8/1998 | Schwab | 337/365 |
| 5,864,278 | A | | 1/1999 | Becher | |
| 5,973,587 | A | * | 10/1999 | Hofsass | 337/377 |
| 6,072,381 | A | * | 6/2000 | Yu | 337/37 |
| 6,100,784 | A | | 8/2000 | Hofsäss | |
| 6,133,817 | A | | 10/2000 | Hofsäss et al. | |
| 6,342,827 | B1 | | 1/2002 | Bührend et al. | |
| 6,538,553 | B2 | * | 3/2003 | Yu | 337/365 |
| 6,580,351 | B2 | * | 6/2003 | Davis et al. | 337/111 |
| 6,621,402 | B2 | * | 9/2003 | Huang | 337/66 |
| 6,633,222 | B2 | * | 10/2003 | Nagai et al. | 337/365 |
| 6,741,159 | B1 | * | 5/2004 | Kuczynski | 337/403 |
| 7,005,957 | B2 | * | 2/2006 | Yu | 337/66 |
| 7,075,403 | B2 | * | 7/2006 | Unno et al. | 337/365 |
| 7,292,131 | B2 | * | 11/2007 | Masuda | 337/365 |
| 2003/0071710 | A1 | * | 4/2003 | Yu | 337/66 |

FOREIGN PATENT DOCUMENTS

| | | | |
|---|---|---|---|
| DE | 1 590 324 | | 12/1971 |
| DE | 2 121 802 | | 1/1973 |
| DE | 25 56 062 | C2 | 1/1989 |
| DE | 196 09 310 | A1 | 9/1997 |
| DE | 197 08 436 | A1 | 9/1998 |
| DE | 198 16 807 | A1 | 10/1999 |
| EP | 0 863 527 | A2 | 9/1998 |
| EP | 0 951 040 | A2 | 10/1999 |
| EP | 0 993 677 | B1 | 4/2000 |
| EP | 0 658 911 | B1 | 1/2002 |
| GB | 1166365 | | 10/1969 |
| GB | 1308230 | | 2/1973 |
| GB | 1 394 612 | | 5/1975 |
| GB | 2 325 345 | A | 11/1998 |
| WO | WO 99/01879 | | 1/1999 |

OTHER PUBLICATIONS http://www.g-rau.de; 3 pages; printed Dec. 5, 2011; actual date of authorship believed to be at least prior to Jun. 5, 2009.

* cited by examiner

BIMETAL PART AND TEMPERATURE-DEPENDENT SWITCH EQUIPPED THEREWITH

CROSS-REFERENCE TO RELATED APPLICATIONS

This is a continuation application of copending international patent application PCT/EP2010/057824, filed Jun. 4, 2010 and designating the United States, which was published in German as WO 2010/139781 A1, and claims priority to German patent application DE 10 2009 025 221.5, filed Jun. 5, 2009. The entire contents of these priority applications are incorporated herein by reference.

FIELD OF THE INVENTION

The present invention relates to a bimetal part for use as an active switching element in a temperature-dependent switch and to a temperature-dependent switch equipped with the bimetal part.

BACKGROUND OF THE INVENTION

Within the scope of the present invention, a bimetal part is understood as meaning a multi-layered active structural part in sheet form comprising two, three or four components with different coefficients of expansion connected inseparably to one another. The individual layers of metals or metal alloys are connected in a materially bonded or interlocking manner, achieved for example by rolling.

Such bimetal parts are commercially available as sheets, see for example the company G. Rau GmbH & Co. KG, Kaiser-Friedrich-Str. 7, 75172 Pforzheim, and their corresponding website at www.rau-pforzheim.de.

It is known in this connection from EP 0 658 911 B1 to use multi-layered bimetal parts as springs and discs in temperature-dependent switches, it being intended to achieve an increase in the possible nominal currents and switching hysteresis by appropriate material selection and composition.

The bimetal part is in this case part of a temperature-dependent switching mechanism which, depending on its temperature, closes or opens an electrically conducting connection between two fixed contact parts provided on the switch.

Such temperature-dependent switches are known in various designs from the prior art.

The bimetal part is in each case generally formed as a spring restrained at one end or a disc loosely inserted.

If the bimetal part is formed as a bimetal spring tongue as in DE 198 16 807 A1, it bears at its free end a movable contact part, which interacts with a fixed contact part. The fixed contact part is electrically connected to a first external connection, a second external connection being electrically connected to the restrained end of the bimetal spring tongue.

Below its response temperature, the bimetal spring tongue closes the electrical circuit between the two external connections by pressing the movable contact part against the fixed contact part.

If the temperature of the bimetal spring tongue increases, it begins to stretch and to deform in a creeping phase, until finally it springs over into its open position, in which it lifts the movable contact part off from the fixed contact part. In this creeping phase, the contact pressure is reduced, which may lead to the formation of arcs, contact erosion and contact chatter.

If, on the other hand, the bimetal part is designed as a bimetal disc, it generally interacts with a spring snap-action disc, which bears the movable contact part which interacts in the way described above with the fixed contact part. The spring snap-action disc is supported by its periphery on an electrode, which is connected to the second external connection. Such a switch is described, for example, in DE 21 21 802 A or DE 196 09 310 A1.

Below its response temperature, the bimetal disc is loosely inserted, is therefore not subjected to any mechanical load. The contact pressure between the fixed contact part and the movable contact part, and consequently the electrical connection between the two external connections, is provided by way of the spring snap-action disc. If the temperature of the known temperature-dependent switch increases, the bimetal disc passes through a creeping phase, in which it gradually deforms until it then suddenly changes over into its open position, in which it acts on the spring snap-action disc in such a way that it lifts off the movable contact part from the fixed contact part, and consequently opens the known switch. The creeping phase has no adverse effects on the contact pressure here.

In the case of the switch described above with the bimetal spring tongue, current flows through the bimetal part itself, so that it heats up as a result of the current flowing through the switch. In this way, the known switch not only reacts to external temperature increases, it also reacts to excessive current flow.

Such switches therefore react temperature-dependently and current-dependently.

By contrast with this, in the case of the switch with a bimetal disc, the bimetal part is always free from current; it is therefore not heated by the flowing current, so that such switches switch largely current-independently.

However, there are also known switches in which a bimetal spring tongue interacts with a spring snap-action part which carries the flowing current, so that in the case of these designs the bimetal spring tongue itself does not carry any current. Conversely, there are also known switches in which a bimetal disc bears the movable contact part and consequently has current flowing through it.

Finally, there are known temperature-dependent switches with two external connections, which are each connected to a fixed contact part, and provided with an electrically conducting contact bridge which carries the flowing current when it lies against the fixed contact parts.

Such switches with a contact bridge are described, for example, in DE 197 08 436 A1. They are intended for applications in which high nominal currents flowing through the switch would cause a current-carrying spring snap-action part or bimetal part to undergo great loading or self-heating.

The contact bridge is in this case carried by a spring snap-action disc, which interacts with a bimetal disc. If the bimetal disc is below its response temperature, it lies freely in the switch without any mechanical loading; the spring snap-action disc presses the contact bridge against the fixed contact parts, so that the circuit is closed. If the temperature increases, the bimetal disc snaps over from its force-free closed position into its open position, in which it works against the spring snap-action disc and lifts the contact bridge from the fixed contact parts.

Even in the case of this switch design, the aforementioned problems in connection with the creeping phase of the bimetal disc occur if it directly bears the contact bridge and provides the contact pressure. That is the reason why the known switch is provided with the spring snap-action disc, which maintains the contact pressure unchanged even in the creeping phase of the bimetal disc.

The switches described thus far are used for the purpose of protecting electrical appliances, such as for example hairdryers, motors for lye pumps, irons, etc., from excessive temperature and possibly excessive current. For this purpose, the known switches are connected with their external connections in series into the supply circuit of the electrical appliance to be protected and are also thermally coupled to the appliance to be protected.

If the temperature of the appliance to be protected increases beyond the switching temperature of the bimetal part, the temperature-dependent switch opens the circuit and the protected appliance can cool down again.

In order to prevent the appliance, and consequently also the bimetal part, from being switched on again after cooling down, it is also known to assign the temperature-dependent switch a shunt resistor, which, when the switch is open, allows through a residual current which heats up the resistor to the extent that the switch remains open. Such switches are referred to as self-holding switches.

It is also known to provide the known switches with a defined current dependence, by connecting in series with the external connections a heating resistor which is flowed through by the operating current of the electrical appliance to be protected and, when there is excessive operating current, heats up in a defined manner and ensures that the switch is opened, since the bimetal part also heats up correspondingly.

Both in the case of switches with a bimetal part through which current flows and in the case of switches with a bimetal part which is free from current, the switchover temperature is decisive for the safety function provided by the switch. The switching temperature must assume different values for different applications, but these values may only fluctuate within narrow limits in order to provide the desired safety.

Against this background, great attention is paid in the design of such temperature-dependent switches to maintaining the transition temperature.

At the same time, temperature-dependent switches with a bimetal part through which current does not flow are preferred, since they have a more constant switchover temperature. One reason for this is that the bimetal part is free from mechanical forces in the closed position, so that it is exposed to far lesser ageing processes than a bimetal part which in the closed position has to provide the contact pressure, which in the case of the other designs is undertaken by the spring snap-action part.

In particular in the case of bimetal parts through which current flows, the aforementioned creeping phase is disadvantageous, since the bimetal part stretches unpredictably in the creeping phase, causing the contact pressure to subside. This may lead to undesired contact chatter, and consequently to undesired contact erosion.

In order to overcome these problems, bimetal parts through which current flows are provided with indentations which for the most part suppress the creeping phase. These indentations ensure that the linear expansions of the two metal layers compensate for one another below the desired transition temperature. However, this leads to mechanical stresses within the bimetal parts, which in turn has adverse effects on the ageing process.

These problems do not occur in the case of the loosely inserted bimetal parts, since with them it is not necessary to suppress the creeping phase.

However, the variants of switches with a bimetal disc and a spring snap-action disc have the disadvantage that the bimetal disc and the spring snap-action disc have to be newly made to match one another with respect to their mechanical and electrical properties each time switches with different transition temperatures or different admissible operating currents are to be designed.

A further disadvantage in the case of switches with a spring snap-action disc and a bimetal disc is the large number of required structural elements, which also results in an overall height which may be problematical in certain applications.

DE 1 590 324 A discloses a bimetal part for a temperature-dependent switch that is formed as an elongated rectangle and is fixedly restrained at its one narrow end, while at its other narrow end there is a movable contact part which interacts with a fixed contact part in such a way that, when the switch is closed, the operating current of the appliance to be protected flows through the bimetal part and the two contact parts that are then in contact with one another.

The longitudinal sides of the bimetal part are folded over in such a way that the bimetal part is double-layered over about a quarter of its width on each of both longitudinal sides. Between the movable contact part and about half the length of the bimetal part, the upper layer of the double-layered longitudinal sides has been removed by punching out rectangles, which each extend over about one quarter of the width of the bimetal part. This has the effect of forming in the lower layer single-layered side webs, which between them delimit a middle web in the upper layer which takes up half the width of the bimetal part. The side webs are shortened by v-shaped stamping, so that the middle web curves convexly.

If the temperature is increased, the middle web bends counter to the bending of the rest of the bimetal part, therefore snaps through between the side webs. In this way it is intended to reduce the temperature interval within which the bimetal part snaps over between its low-temperature position and its high-temperature position.

The partly single-layered and partly double-layered structure of the known bimetal part and the shortening of the side webs have the effect that the actuating forces in the middle web and in the side webs vary greatly. Furthermore, the structure is mechanically complex and is weakened in its strength by the two punched-out rectangles.

This has the effect that the known bimetal part cannot be set exactly with respect to its transition temperature, the transition temperature not being stable in the long term because of the mechanically asymmetrical loads.

Furthermore, the known bimetal part can only be used as a bimetal spring which is restrained at one end and through which current flows, which involves the disadvantages described above.

U.S. Pat. No. 2,249,837 A describes a similar bimetal part. The known bimetal part is formed in a single-layered manner as an elongated rectangle and is fixedly restrained at its one narrow end, while at its other narrow end it bears a movable contact part, which interacts with a fixed contact part in such a way that, when the switch is closed, the operating current of the appliance to be protected flows through the bimetal part.

The bimetal part is divided by two slits running in the longitudinal direction into a middle web and two outer webs, the webs merging with one another in one piece at the narrow ends of the bimetal part. The bimetal part is deformed by bending and heat treatment in such a way that the middle web is curved down more than the two outer webs.

By adjusting the relative height of the fixed contact part in relation to the restrained narrow end of the bimetal part, the curvature of the middle web is adjusted further in comparison with the bending of the outer webs, whereby the opening temperature of the temperature-dependent switch equipped with the bimetal part is changed.

This known bimetal part can also only be used as a bimetal spring which is restrained at one end and through which current flows, which involves the disadvantages described above. Furthermore, the opening temperature must be set by subsequent adjustment work, which is likewise disadvantageous.

As a result of the different curvature of the middle web on the one hand and the side webs on the other hand, the actuating forces in the middle web and in the side webs vary greatly. This has the effect that in the case of the known part the transition temperature is not stable in the long term because of the mechanically asymmetrical loads.

SUMMARY OF THE INVENTION

In view of the above, it is an object of the present invention to improve the bimetal part mentioned at the outset and the temperature-dependent switches mentioned at the outset in such a way that the disadvantages to be encountered in the prior art are avoided, it being intended for the mechanical structure of the switches to be simple and inexpensive.

According to one embodiment of the invention the bimetal part mentioned at the outset has at least one inner region and an outer region surrounding the at least one inner region, the inner region and the outer region being formed such that in certain portions they are in one piece with one another and in certain portions they are mechanically separated from one another and being stamped in opposite directions, and at least one contact area being provided on the inner region.

The inventor of the present application has recognized that with bimetal parts it is possible, as it were, to provide an internal opposing force, by the inner region and the outer region deforming oppositely in the region of the switching point. This is achieved by the stamping in opposite directions and by the inner region and the outer region being mechanically separated from one another in certain portions, so that they can move freely with respect to one another there, but on the other hand being formed in one piece with one another in certain portions, so that they cannot be displaced with respect one another in the longitudinal or radial direction.

The inventor has further recognized that this means that the creeping phases are, as it were, blocked. The switching point is stable in the long term and is not influenced by mechanical loads, by current flow or by ageing processes. Furthermore, the conformational change between the high-temperature position and the low-temperature position takes place very abruptly. Finally, no switching hysteresis occurs, or only a negligible switching hysteresis.

Because the contact area is provided on the inner region, the bimetal part can be firmly clamped on the outer region at a number of points, so that it is restricted in its longitudinal or radial expansion. This enforces a bending of the inner region and the outer region in opposite directions, the bimetal part being symmetrically designed overall, which leads to favourable mechanical conditions and uniform mechanical loads.

Furthermore, not only are the movements of the inner region and the outer region during the transition between the high-temperature position and the low-temperature position opposing, the distances covered during the bending of the regions are also equal, which is attributable to the stamping in opposite directions.

All of this has the effect that temperature-dependent switches equipped with the novel bimetal part switch very reliably and reproducibly over many switching cycles.

How bimetal parts are provided with stampings is sufficiently well known in the prior art. "Stamped in opposite directions" is thus understood within the scope of the present invention as meaning that the inner region and the outer region are provided with indentations, also referred to as cups or dimples, from different sides, so the openings thereof lie on different sides of the bimetal part.

According to other embodiments, the novel bimetal part is used in any of the switch designs mentioned at the outset; the disclosures of DE 197 08 436 A1, DE 21 21 802 A, DE 196 09 310 A1 and DE 198 16 807 A1 are therefore included by reference.

The novel bimetal part may be used without or with current flowing through it, but it is not used as a bimetal spring restrained at one end, so that it does not have the disadvantages that involves.

According to a further embodiment, a temperature-dependent switch with two external connections and a temperature-dependent switching mechanism which, depending on its temperature, closes or opens an electrically conducting connection between the two external connections, includes the novel bimetal part as an active switching element in the switching mechanism.

A great advantage of the novel switch is that it dispenses with spring snap-action discs, so that the novel switch can be constructed with few components and with a small overall height.

It can be seen as a further advantage that switches with different response temperatures and nominal currents can now be constructed mechanically identically in principle; only the respective bimetal part has to be differently designed to correspond to the transition temperatures and nominal currents. It is no longer required as in the prior art to make a temperature-dependently switching bimetal part and a spring snap-action disc match.

This allows an existing product range also to be subsequently extended unproblematically, by developing and fitting further bimetal parts.

On the one hand, it is accordingly preferred if the bimetal part is in connection by way of its outer region with one of the two external connections, and at its inner region interacts, preferably by way of a movable contact part, with a fixed contact part, which is in connection with the other external connection.

In an alternative, the switching mechanism comprises a spring tongue, which at its fixed end is in connection with one of the two external connections, and at its free end bears a movable contact part, which interacts with a fixed contact part which is in connection with the other external connection, the bimetal part interacting with the spring tongue in such a way that the movable contact part is lifted from the fixed contact part when a switching temperature is reached.

These are the two "classic" design variants for temperature-dependent switches, which now both make use of the bimetal part according to the invention.

At the same time, design variants with a bimetal part through which current flows have the further advantage that the contact pressure is applied by the bimetal part, so that the switch is constructed in a simple manner and with a small overall height.

It is also preferred if the bimetal part bears on its inner region a contact bridge, which interacts with two fixed contact parts which are each in connection with one of the external connections.

With this use of the bimetal part according to the invention, the contact bridge may be borne directly by the bimetal part since, because of the improved ageing resistance, it can provide a permanently good contact pressure between the contact bridge and the stationary contacts as long as the temperature remains below the response temperature or snap-over temperature of the bimetal part. The spring snap-action disc used until now in the prior art is no longer required.

According to still another embodiment, the bimetal part is formed as an approximately rectangular spring, which preferably comprises as an inner region at least one inner web extending in the longitudinal direction of the spring and as an outer region at least two outer webs extending in the longitudinal direction of the spring, which outer webs accommodate the inner web between them and are each separated from it by way of a gap extending in the longitudinal direction, the inner web also preferably having mechanical properties comparable to those of the outer webs together.

These measures have the effect of providing an active switching element which does not change its mechanical and electrical properties even after many switching cycles and switches almost without any creeping phase, so that the disadvantages that the creeping phase involves in the prior art are avoided.

According to a further embodiment, the bimetal part is formed as a disc, the inner region preferably being surrounded by a gap which is interrupted in certain portions, and the gap also preferably running in a zigzagging, meandering or wavy manner, the inner region preferably having mechanical properties comparable to those of the outer region.

These measures also have the effect of providing an active switching element that is stable in the long term.

In certain embodiments, the inner region bears a movable contact part, which is preferably fixed in an interlocking or non-positively engaging manner, and on which the at least one contact area is formed, or bears a contact bridge with two contact areas, or if the contact area is integrated in the one region.

These measures have the effect of providing a good electrical contact with a mating contact with which the contact area interacts.

If a contact part which is fixed in an interlocking or non-positively engaging manner is used for this purpose, as a result the mechanical properties of the bimetal part are influenced considerably less than if—as in the prior art—the contact part were connected to the bimetal part in a materially bonded manner, which in the prior art takes place particularly by welding. However, the inventor of the present application has recognized that this materially bonded connection has the disadvantage that, as a result, the mechanical and electrical properties of the bimetal part are subsequently changed unpredictably.

These problems no longer occur with the non-positively engaging or interlocking connection, which can be achieved for example by adhesive bonding, riveting or clamping.

The interlocking or non-positively engaging connection of the movable contact part to the bimetal part therefore involves the advantage that, once the mechanical and electrical properties of the bimetal part have been set, they are not subsequently changed.

This measure therefore provides further stability and reliability of the switching point.

However, particular advantages are obtained if the contact area is integrated in the one region. This is so because it is then possible to dispense with the separate movable contact part, which is accompanied by cost advantages and assembly advantages.

The integrated contact area even influences the mechanical properties of the flexible bimetal part considerably less than a contact part fastened in an interlocking or non-positively engaging manner.

This integrated contact area is also in itself novel and inventive.

In a further embodiment, the present invention relates to a bimetal part for use as an active switching element in a temperature-dependent switch with a flexible region in which a contact area is integrated.

The bimetal part may in this case be of a classic construction; it therefore does not have to have at least one inner region and an outer region surrounding the at least one inner region, the inner region and the outer region being formed such that in certain portions they are in one piece with one another and in certain portions they are mechanically separated from one another and being stamped in opposite directions.

In other embodiments, either the contact area is connected to the one region in a materially bonded manner, preferably by plating or electrocoating with a conductive material, or the contact area is connected to the one region in an interlocking manner, preferably by incorporating a conductive material by rolling.

In this way, the one region of the bimetal part is provided with a contact area that has good electrical conductivity and permits a low transition resistance with respect to a contact area lying against it, without the flexibility of the bimetal part being adversely influenced.

Further advantages emerge from the description and the accompanying drawing.

It goes without saying that the features mentioned above and still to be explained below can be used not only in the respectively specified combinations but also in other combinations or on their own without departing from the scope of the present invention.

BRIEF DESCRIPTION OF THE DRAWINGS

Three embodiments of the invention are represented in the drawing and are explained in more detail in the description which follows. In the drawing.

DESCRIPTION OF PREFERRED EMBODIMENTS

Figure 1:
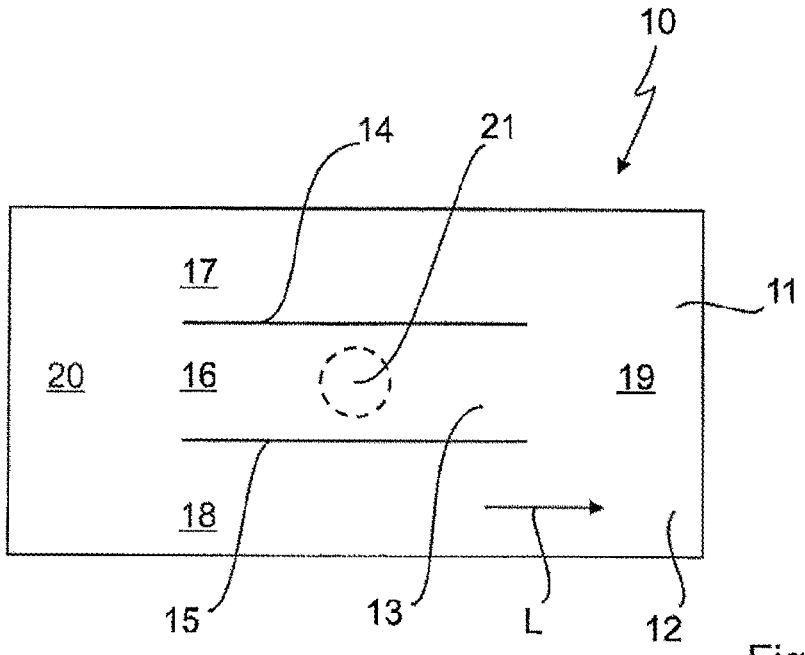
FIG. 1 shows a schematic view of a first embodiment of a bimetal part according to the invention in plan view.

FIG. 1 shows in a schematic plan view a bimetal part 10, which in the present case is formed as a rectangular spring 11. The spring 11 is divided into an outer region 12 and an inner region 13.

The two regions 12 and 13 are formed such that in certain portions they are in one piece with one another. In certain portions they are also mechanically separated from one another by two slits or gaps 14 and 15 running in the longitudinal direction L, in such a way that there forms an inner web 16, which is surrounded by two outer webs 17 and 18.

The slits or gaps 14, 15 are produced by punching, cutting or other suitable separating measures. This creates such a clearance between two neighbouring webs 16, 17; 16, 18 that it makes it possible for these webs 16, 17, 18 to bend without being mechanically hindered by the respectively neighbouring web 16, 17, 18. As long as this condition is satisfied, the slits or gaps 14, 15 may have transversely in relation to the longitudinal direction L a clear width between neighbouring webs 16, 17, 18 that is obtained by the chosen separating method.

All three webs 16, 17, 18 are connected in one piece to end regions 19, 20 of the sheet-metal part 11 that are opposite from one another in the longitudinal direction L. In this way, the webs 17 and 18 and the end regions 19, 20 form the outer region 12, which completely surrounds the web 16, that is to say the inner region 13. The webs 16, 17, 18 consequently cannot be displaced with respect to one another in the longitudinal direction L.

It goes without saying that it is possible to divide the inner region 13 into a number of inner webs 16 running parallel to one another, which are mechanically separated from one another by further gaps or slits parallel to the longitudinal direction L.

Figure 8:
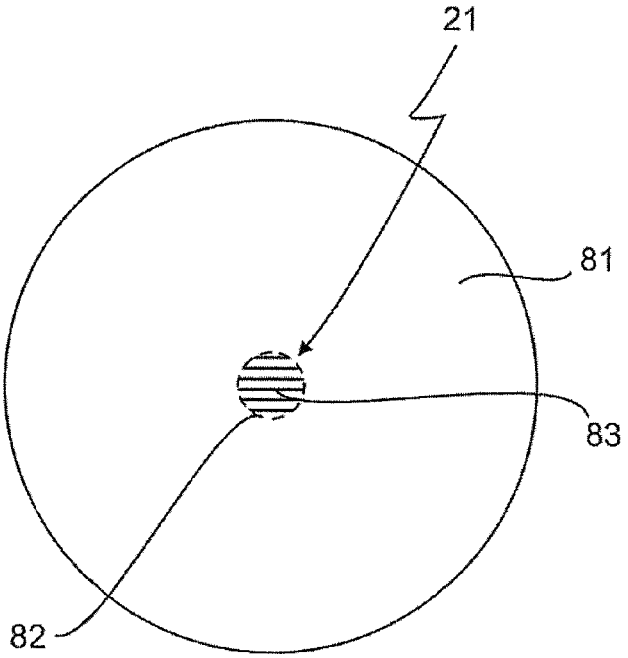
FIG. 8 shows a plan view of a bimetal part with an integrated contact area.

On the inner web 16 there is indicated at 21 a region at which a contact part is fastened in a non-positively engaging or interlocking manner, according to the example of FIG. 5, or a contact bridge is fastened, according to the example of FIG. 6, or at which an integrated contact area is provided, as will be explained in still more detail below in conjunction with FIG. 8.

Figure 2:
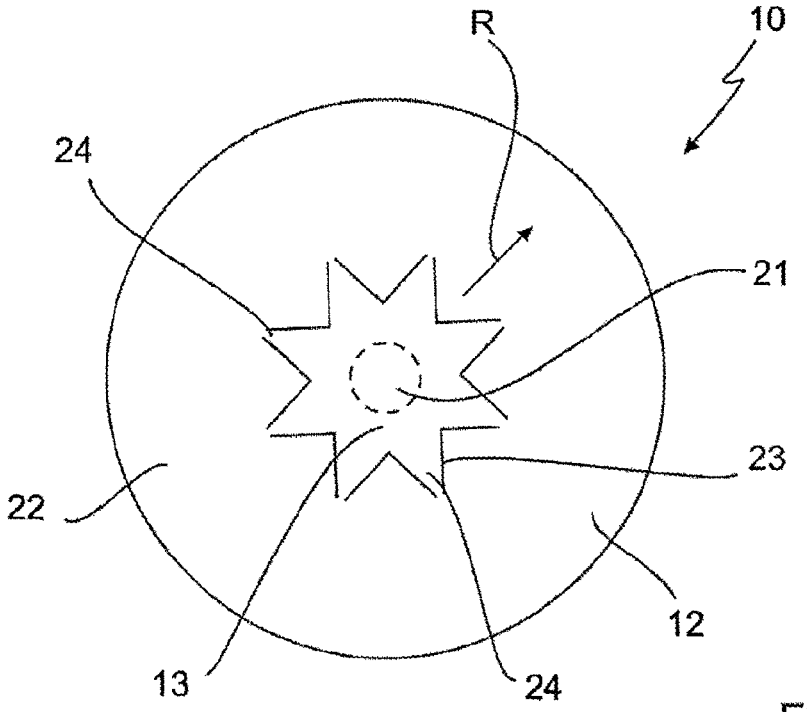
FIG. 2 shows a schematic view of a second embodiment of a bimetal part according to the invention in plan view.

In a second embodiment, represented in FIG. 2, the bimetal part 10 is formed as a disc 22, which in the embodiment shown is circular in plan view. However, the disc 22 may also assume other forms, for example may be configured in an oval or elliptical manner.

The disc 22 likewise has an outer region 12, which surrounds an inner region 13. The two regions 12, 13 are mechanically separated from one another in certain portions by a gap 23 comprising V-shaped slits arranged in a circumferentially distributed manner, so that the inner region 13 assumes the form of a jagged star. The V-shaped slits are interrupted at their tips 24, so that here in certain portions the inner region 13 and the outer region 12 merge with one another in one piece and are fixed with respect to one another in the radial direction R.

In terms of their function, the V-shaped slits correspond to the slits or gaps 14, 15 in the spring 11 from FIG. 1 and have likewise been produced by punching, cutting or other suitable separating methods. In this way, the inner region 13 and the outer region 12 can deform without being mechanically hindered in the region of the gap 23 by the region lying opposite at the respective slit.

Instead of the V-shaped slits, other meandering or wavy slits which are interrupted in certain portions may also be provided in order to establish the one-piece connection between the inner region and the outer region.

On the inner region 13 there is again indicated a region 21 in which a contact area is integrated as explained below on the basis of FIG. 8 for an otherwise conventional bimetal disc, that is to say without an inner region and an outer region.

The spring 11 and the disc 22 are punched out from a sheet of bimetal, whereby they are given their outer form and possibly also provided in this first operation with the slits 14, 15, 23. In two further punching operations, the inner region 13 and the outer region 12 are then stamped in such a way that their creeping phases are suppressed, which was explained at the beginning. One of these two punching operations may also be accomplished during the first operation.

Figure 1A:
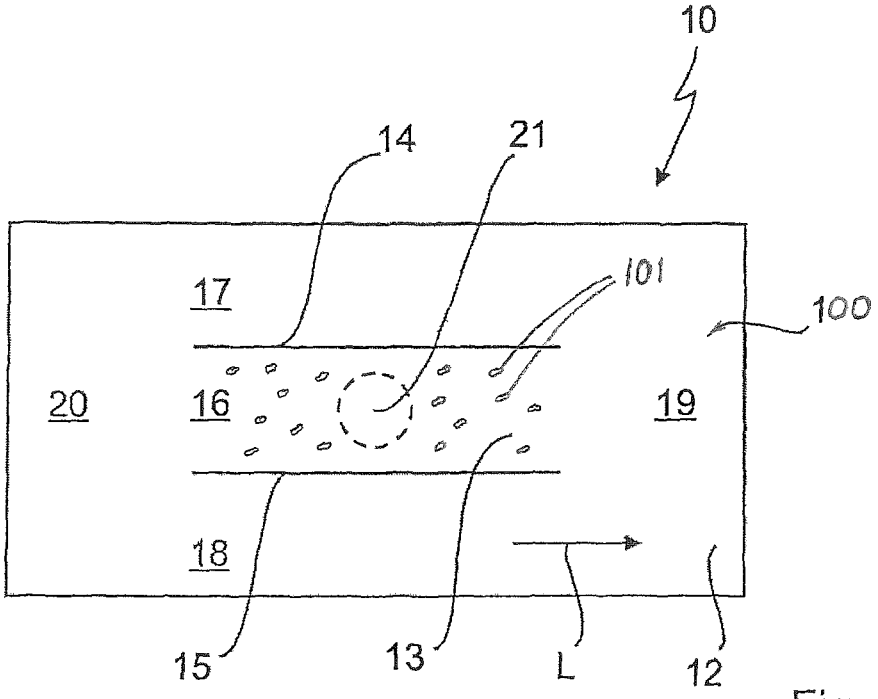
FIG. 1*a* is a schematic view of the upper surface of the bimetal part of FIG. 1, showing the indentations formed on the inner region.
Figure 1B:
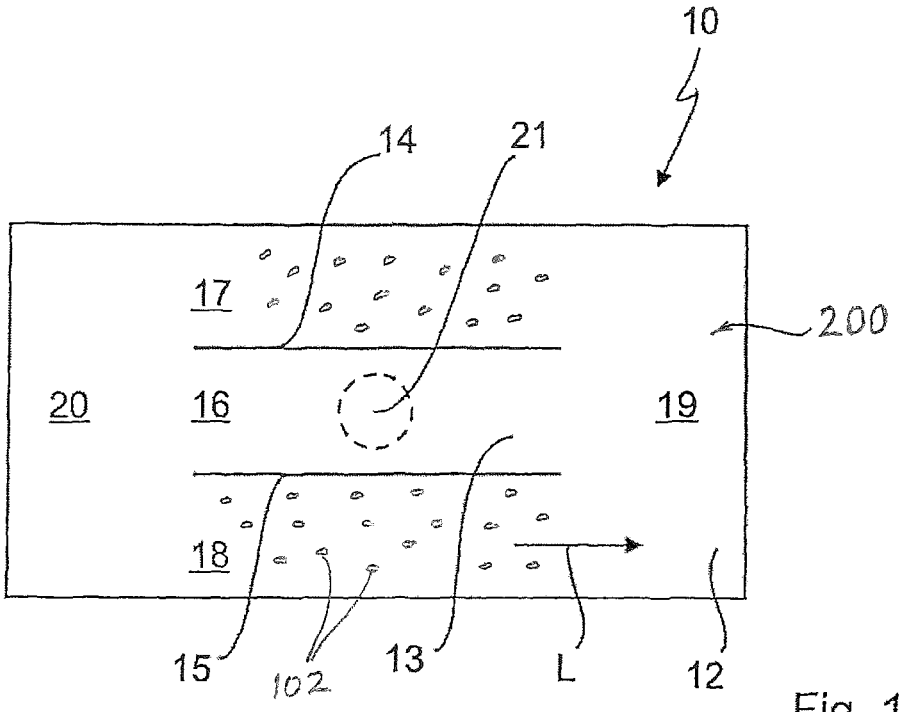
FIG. 1*b* is a schematic view of the lower surface of the bimetal part of FIG. 1, showing the indentations formed on the outer region.

These punching operations are then performed in such a way that the outer region 12 and the inner region 13 are stamped in opposite directions, but have the same properties. For the spring 11, this means that the inner web 16 has mechanical properties comparable to those of the outer webs 17 and 18 together. In other words, the stamping involves introducing dimples or depressions 101, 102 which lie on the upper side 100 of the inner web 16 and the lower side 200 of the outer webs 17 and 18, or vice versa (FIGS. 1*a* and 1*b*). Depending on the requirement, both the inner web 16 and the outer webs 17 and 18 may also have stampings on the upper side and underside, just with opposing arrangement and effect.

After the punching operations, the inner region 13 and the outer region 12 of the bimetal part are still in one plane, if the said part is not mechanically stressed.

If the bimetal part 10 heats up, consequently the one region 12, 13 bends in one direction and the other region bends at the same time in the other direction if the transition temperature is exceeded. The stamping and the choice of geometry in this case have the effect of largely suppressing the creeping phase, so that the bending takes place abruptly and in opposite directions.

The chosen geometry, the dimensions and the appropriate material selection as well as the stamping have the effect that the bimetal part 10 consequently includes, as it were, its own counter bearing. This produces an internal equalization of forces, so that a switching point that can be maintained very exactly can be established, since the creeping phases are efficiently suppressed.

In other words, the switching over between the high-temperature position and the low-temperature position takes place abruptly and reproducibly over many switching cycles. Furthermore, the switching hysteresis is largely suppressed.

The bimetal part 10 can therefore absorb mechanical forces and carry current even over long periods of time without its properties changing due to ageing processes.

Consequently, in the two embodiments of spring 11 and disc 22, the bimetal part 10 can be used as an active switching element in a temperature-dependent switch, as was discussed at length at the outset. The inner region 13 in this case performs the switching function.

Because of the opposing properties of the inner region 13 and the outer region 12, it is not necessary—but is also not ruled out—that the bimetal part 10 is assigned a spring snap-action part, which provides the contact pressure in the closed state of the switch and possibly also carries the operating current of the appliance to be protected.

The inner region 13 may therefore directly bear a movable contact part or a contact bridge. In the case of this novel bimetal part 10, the mechanical loading and the current flow during the closed states of the switch no longer lead to the ageing effects and displacements of the switching point that are known from the prior art.

The properties of the novel bimetal part 10 can be used particularly effectively if the disc 22 is held immovably with respect to the switch at its outer periphery 25 or the spring 11 is held immovably with respect to the switch at its end faces 26, 27, facing away from one another in the longitudinal direction L.

This enforces a constant length of the spring 11 in the longitudinal direction L or of the disc 22 in the radial direction R, so that the inner region 13 and the outer region 12 can only snap over at the same time and in different directions. This contributes to the uniform distribution of the mechanical loading, and consequently to an even further improved long-term stability of the switchover point.

Figure 3:
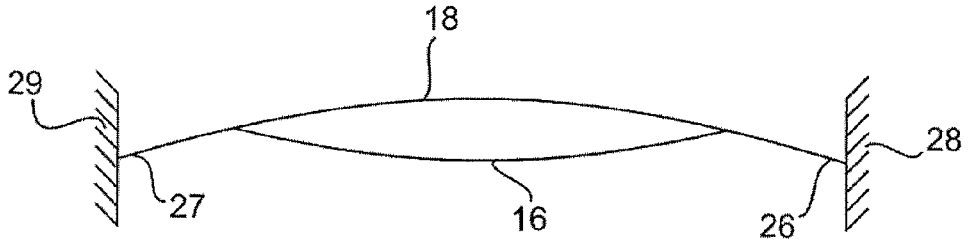
FIG. 3 shows a schematic side view of the bimetal part from FIG. 1 in a first switching position.
Figure 4:
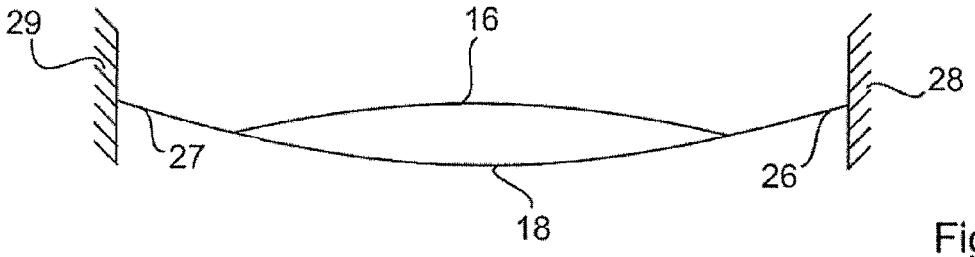
FIG. 4 shows a schematic side view of the bimetal part from FIG. 1 in a second switching position.

This arrangement is schematically shown in the side view according to FIGS. 3 and 4, where the spring 11 from FIG. 1 is held by its end faces 26, 27 on two abutments 28, 29. In the low-temperature position shown in FIG. 3, the inner web 16 has been bent downwards, in the high-temperature position shown in FIG. 4 it has been bent upwards. The outer webs 17, 18, of which only the web 18 can be seen in FIGS. 3 and 4, have been bent oppositely.

The transition between the switching positions according to FIGS. 3 and 4 takes place abruptly when the temperature exceeds or falls below the switching temperature, which is determined by the material, geometry and stamping.

Figure 5:
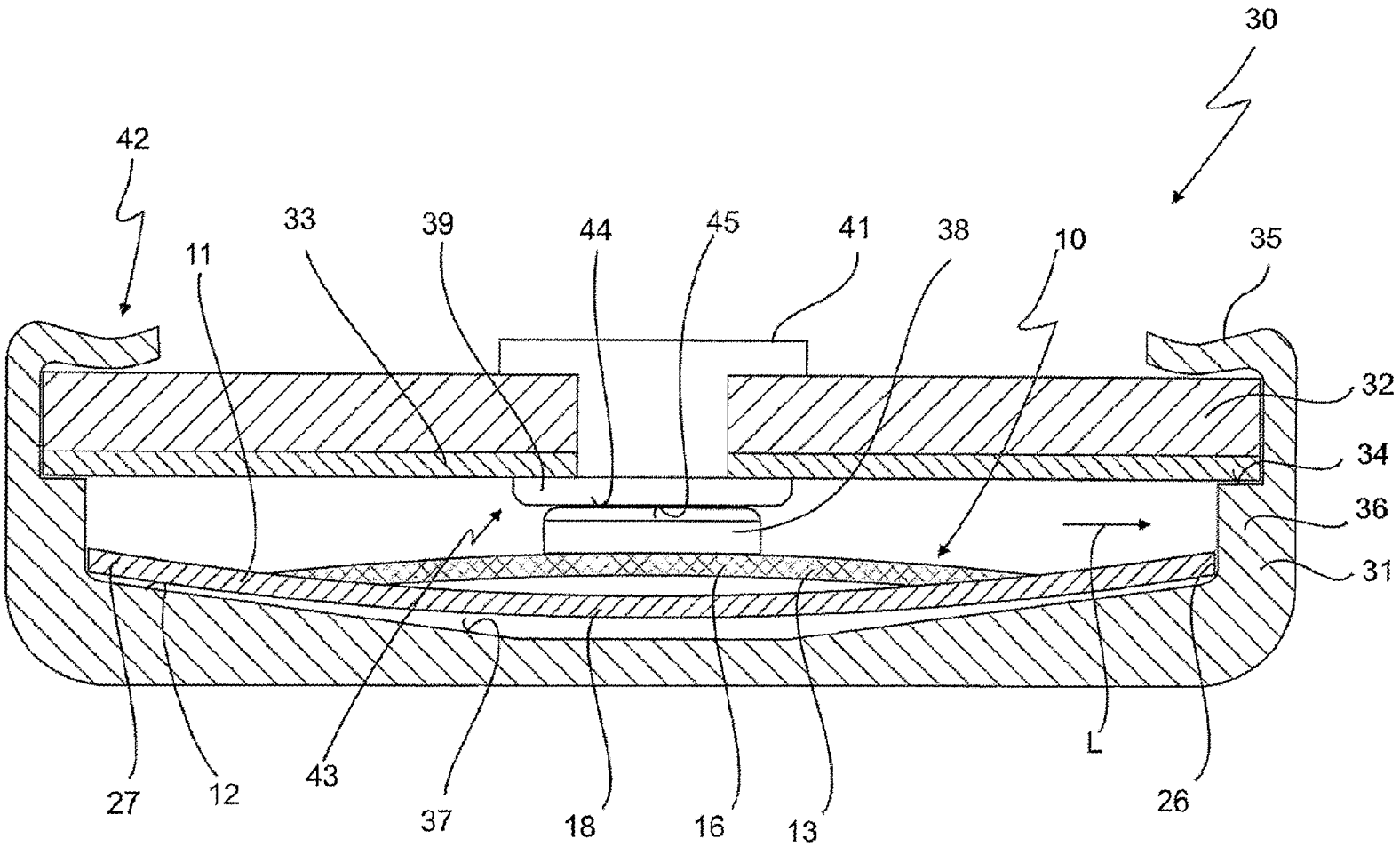
FIG. 5 shows a first embodiment of a temperature-dependent switch with the bimetal part from FIG. 1 in a schematic sectional representation.

Shown in a schematic, sectional side view in FIG. 5 is a temperature-dependent switch 30 which is a first embodiment of the use of the bimetal part 10, formed in the present case as a spring 11, as an active switching element in a temperature-dependent switching mechanism.

The switch 30 comprises a pot-like lower part 31 of conducting material, which is closed by an upper part 32 of likewise conducting material. With an insulating layer 33 interposed, the upper part 32 has been placed onto a shoulder 34 of the lower part 31 and fastened firmly to the lower part 31 by way of a flanged periphery 35.

The lower part 31 has a peripheral side wall 36, on which the shoulder 34 is formed.

In the closed position shown in FIG. 5, the spring 11 is supported by its end faces 26 and 27, and consequently by its outer region 12, on an inner base of the lower part 31 acting as an electrode 37, and is fixed in the longitudinal direction L by the side wall 36. The side wall 36 acts in this case as an abutment in the sense of the abutments 28, 29 from FIGS. 3 and 4.

The outer webs, of which only the web 18 can be seen in FIG. 5, have been bent downwards; the inner web 16 has been bent upwards and thereby presses a movable contact part 38 borne by it against a fixed contact part 39, which is arranged on the upper part 32. The fixed contact part 39 is formed in the manner of a rivet, the head 41 of which, resting on the outside, serves as a first external connection, with which the inner region 13 is consequently in electrical connection.

The flanged periphery 35 serves as a second external connection 42.

The spring 11 forms together with the movable contact part 38 a temperature-dependent switching mechanism 43 which, depending on its temperature, closes or opens an electrically conducting connection between the external connections 41 and 42.

In the closed position shown in FIG. 5, which corresponds to the configuration schematically shown in FIG. 4, the end faces 26, 27 are in electrically conducting connection by way of the base 37 with the second external connection 42, while the movable contact part 38 is connected in an electrically conducting manner to the first external connection 41 by abutment with the first contact part 39. For this purpose, the movable contact part 38 is provided with a contact area 44, which when the switch 30 is closed comes into abutment with a contact area 45, which is provided on the fixed contact part 39.

In this way, an electrically conducting connection between the external connections 41 and 42 is established by way of the spring 11.

If the temperature of the spring 11 increases beyond the response temperature, the spring 11 abruptly snaps over without any creeping phase from the configuration shown in FIG. 5 into its open position, which is schematically shown in FIG. 3. The inner web 16 thereby bends downwards and lifts the movable contact part 38 from the fixed contact part 39, whereby the circuit is opened. At the same time, the outer webs 17, 18 likewise snap over.

The movable contact part 38 thereby moves together with the inner web 16 through between the outer webs 17 and 18.

Figure 6:
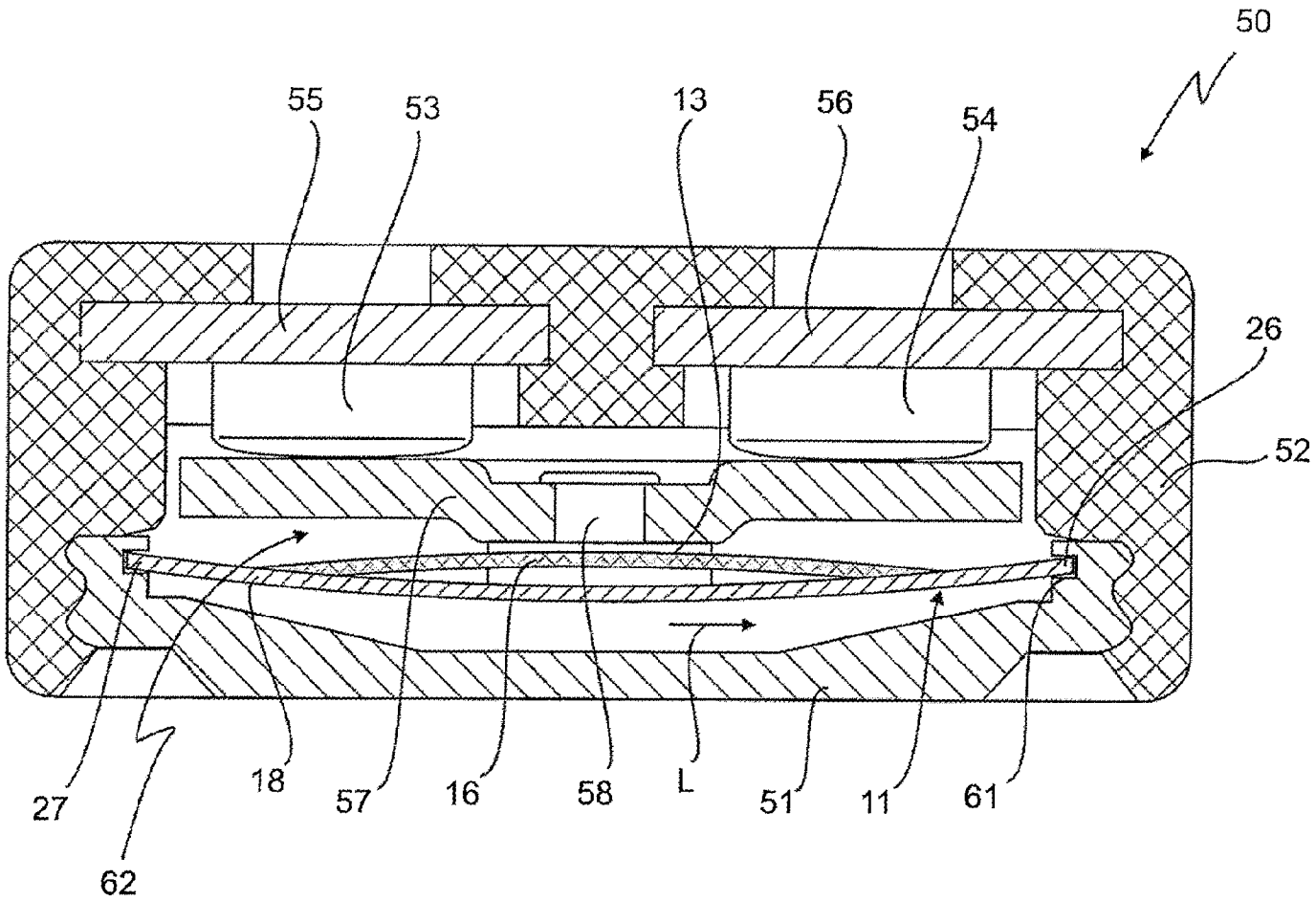
FIG. 6 shows a second embodiment of a temperature-dependent switch with the bimetal part from FIG. 1.

FIG. 6 shows a temperature-dependent switch 50 as known from DE 197 08 46 A1, cited at the outset, the disclosure of which is incorporated by reference.

The switch 50 has a lower part 51, which is closed by an upper part 52. Arranged in the upper part 52 are two fixed contact parts 53, 54, which are connected to external connections 55, 56. Two contact areas on a contact bridge 57, which is fastened by way of a rivet 58 to the inner web 16 of a bimetal part 10 according to the invention that is formed as a spring 11, interact with the fixed contact parts 53, 54.

The spring 11 is fixed by its end faces 26, 27 in a groove 61 of the lower part 51, which consequently serves as an abutment.

Together with the contact bridge 57 and the rivet 58, here the spring 11 forms a temperature-dependent switching mechanism 62 which, depending on its temperature, closes or opens an electrically conducting connection between the external connections 55 and 56.

In the position shown in FIG. 6, the switch 50 is closed; the inner web 16 provides the contact pressure between the contact bridge 57 and the fixed contact parts 53, 54. If the temperature of the switch 50, and consequently of the spring 11, increases, here too this does not lead to a creeping phase that impairs the contact pressure. Only when the switching temperature is reached does the spring 11 snap over from the position shown in FIG. 6, which corresponds to the position from FIG. 4, into the position according to FIG. 3, in which the inner web 16 lifts the contact bridge 57 from the fixed contact parts 53, 54 and opens the switch 50.

The outer webs 17, 18 thereby likewise snap over into their high-temperature position, the contact bridge 57 together with the inner web 16 moving through between the outer webs 17 and 18.

Figure 7:
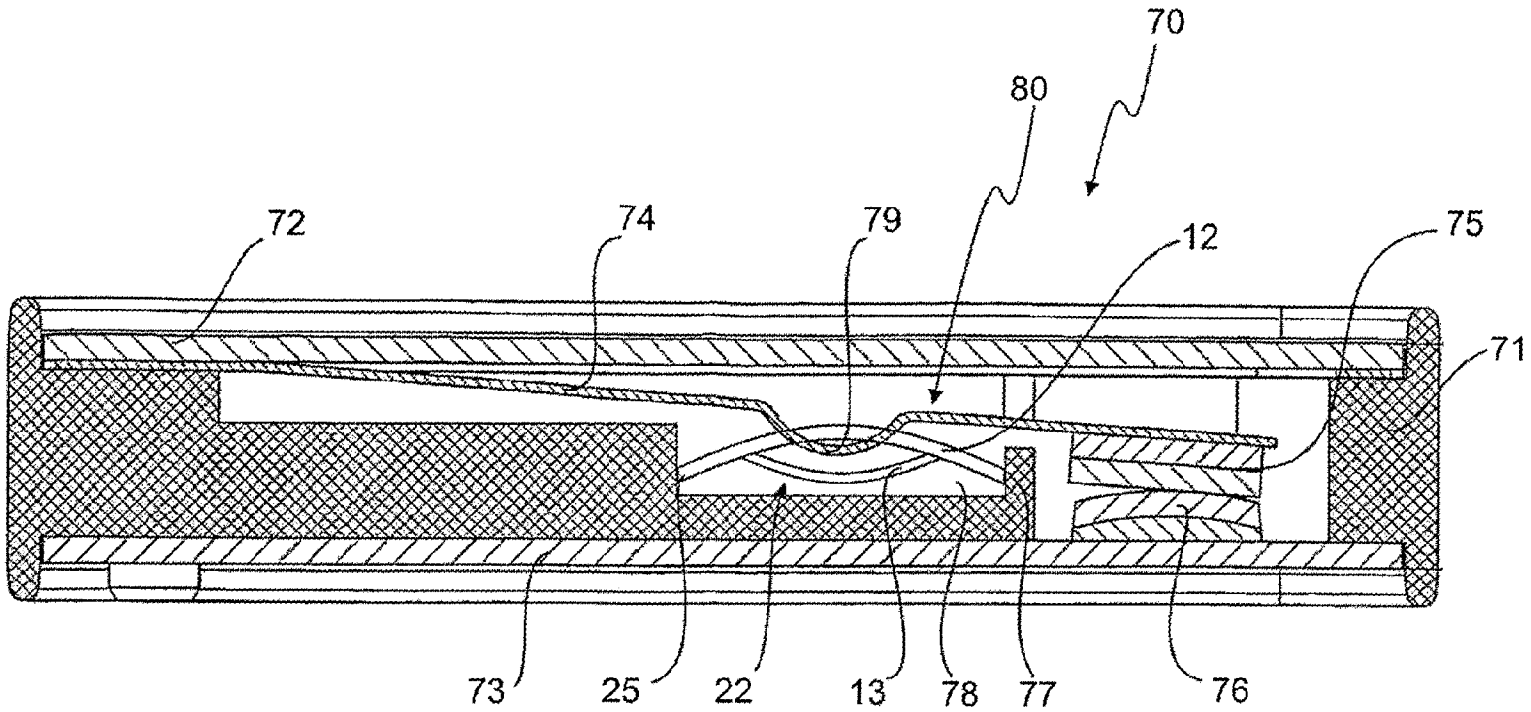
FIG. 7 shows a third embodiment of a temperature-dependent switch with the bimetal part from FIG. 1.

Shown in FIG. 7 is a temperature-dependent switch 70 in which the disc 22 from FIG. 2 is used as an active switching element. The disc is not flowed through by the current to be switched, as in the case of the switch 30 from FIG. 5; it also does not produce the contact pressure, as in the case of the switch 50 from FIG. 6.

The switch 70 has a plastic body 71, which is closed at the top and bottom by metal sheets 72, 73, which serve as external connections. Lying against the upper metal sheet 72 in electrically conducting connection is a spring tongue 74, which at its free end bears a movable contact part 75, which in the low-temperature position shown is in abutment with a fixed contact part 76, which is arranged on the lower metal sheet 73.

Formed in the plastic body 71 by a wall 77 is a receiving space 78, in which there lies the disc 22, which lies with its periphery 25 against the periphery 77 acting as an abutment, and is thus fixed in the radial direction R.

On the spring tongue 74 there can be seen a downwardly facing hemispherical surface 79, against which the disc 22 acts by way of its inner region 13 when it changes its configuration as a result of an increase in temperature and lifts the movable contact part 75 from the fixed contact part 76.

The spring tongue 74, disc 22 and contact parts 75, 76 thereby form a temperature-dependent switching mechanism 80.

In the closed position of the switch 70 that is shown in FIG. 7, the disc 22 through which current does not flow is in a configuration similar to that in FIG. 3; the hemispherical surface 79 protrudes into the outer region 12, from which the inner region 13 has been bent downwards. When switching occurs, the inner region 13 springs upwards, reaches the configuration of FIG. 4 and thereby presses the spring tongue 74 upwards by way of the hemispherical surface 79.

Instead of fitting a movable contact part or a contact bridge, as in the case of the switches from FIGS. 5 and 6, the bimetal part 10 may also be provided with a region 21 in which a contact area is integrated, as is indicated in FIGS. 1 and 2.

It will now be explained on the basis of FIG. 8 for an otherwise conventional bimetal disc 81, that is to say without any inner region and outer region, how an integrated contact area 82 can be produced in an approximately central flexible region 21.

On the one hand, a contact area 82 connected in a materially bonded manner to the region 21 can be produced by plating or electrocoating with a conductive material 83.

On the other hand, the contact area 82 may be produced by incorporating a conductive material 83, for example gold wires, by rolling, whereby the contact area is connected to the region 21 in an interlocking manner.

In this way, the flexible region 21 of the bimetal disc 81 is provided with a contact area 82 which has good electrical conductivity and a low transition resistance with respect to a contact area lying against it, while the flexibility of the bimetal part is not adversely influenced.

The bimetal disc 81 can be used in the case of the switch from FIG. 5 or 6, the movable contact part 38 or the contact bridge 57 now being replaced, as it were, by the integrated contact area 82.

Therefore, what is claimed is:

1. A sheet-like bimetal part for use as an active switching element in a temperature-dependent switch, the bimetal part having a transition temperature, an upper surface and a lower surface and further comprising:

at least one inner region and an outer region surrounding the at least one inner region, the inner region and the outer region being formed such that in first portions they are in one piece with one another and in second portions they are mechanically separated from one another, the inner region and the outer region being stamped in opposite directions so that indentations are formed in the upper surface of one of said inner and outer regions and in the lower surface of the other of said inner and outer regions, such that the entirety of the inner region and outer region except for said indentations are in one plane when the bimetal part is free of mechanical stress and bend in opposite directions when the transition temperature of the bimetal part is exceeded, and at least one contact area being provided on the inner region.

2. The bimetal part of claim 1, which is formed as a rectangular spring.

3. The bimetal part of claim 2, wherein:

said at least one inner region comprises at least one inner web extending in a longitudinal direction of said spring, said outer region comprises at least two outer webs extending in said longitudinal direction of said spring, and the at least one inner web is accommodated between said at least two outer webs, the at least two outer webs being separated from said at least one inner web each by means of a gap extending in the longitudinal direction of said spring.

4. The bimetal part of claim 3, wherein the at least one inner web has mechanical properties like those of the at least two outer webs when taken together.

5. The bimetal part according to claim 1, which is formed as a disc.

6. The bimetal part of claim 5, wherein the at least one inner region is surrounded by gap portions.

7. The bimetal part of claim 6, wherein the gap portions run in a zigzagging manner.

8. The bimetal part of claim 3, wherein the at least one inner web has mechanical properties comparable to those of the at least two outer webs when taken together.

9. The bimetal part of claim 1, wherein the at least one inner region bears a contact bridge with two contact areas.

10. The bimetal part of claim 1, wherein the at least one inner region bears a movable contact part on which the at least one contact area is formed.

11. The bimetal part of claim 10, wherein the movable contact part is fixed to the at least one inner region in an interlocking manner.

12. The bimetal part of claim 10, wherein the movable contact part is fixed to the at least one inner region in a non-positively engaging manner.

13. The bimetal part of claim 1, wherein the contact area is integrated in the at least one inner region.

14. The bimetal part of claim 3, wherein the contact area is integrated in the at least one inner region.

15. The bimetal part of claim 13, wherein the contact area is connected to the at least one inner region in a materially bonded manner.

16. The bimetal part of claim 13, wherein the contact area is connected to the at least one inner region in an interlocking manner.

17. A temperature-dependent switch comprising two external connections and a temperature-dependent switching mechanism which, depending on its temperature, closes or opens an electrically conducting connection between the two external connections by means of an active switching element, wherein said active switching element comprises the bimetal part of claim 1.

18. A temperature-dependent switch comprising two external connections and a temperature-dependent switching mechanism which, depending on its temperature, closes or opens an electrically conducting connection between the two external connections by means of an active switching element, wherein said active switching element comprises the bimetal part of claim 3.

19. A temperature-dependent switch comprising two external connections and a temperature-dependent switching mechanism which, depending on its temperature, closes or opens an electrically conducting connection between the two external connections by means of an active switching element, wherein said active switching element comprises the bimetal part of claim 6.

20. The temperature-dependent switch of claim 17, wherein the bimetal part is in connection by way of its at least two outer regions with a first of the two external connections, and at its at least one inner region interacts with a fixed contact part, which is in connection with a second of the two external connection.

21. The temperature-dependent switch of claim 17, wherein the bimetal part bears on its at least one inner region a contact bridge, which interacts with two fixed contact parts which are each in connection with one of the two external connections.

22. The temperature-dependent switch of claim 17, wherein the switching mechanism comprises a spring tongue, which at its fixed end is in connection with a first of the two external connections, and at its free end bears a movable contact part, which interacts with a fixed contact part which is in connection with a second of the two external connection, the bimetal part interacting with the spring tongue in such a way that the movable contact part is lifted from the fixed contact part when a switching temperature is reached.

23. The temperature-dependent switch of claim 17, wherein the bimetal part is formed as a rectangular spring, which is mounted at both its end faces immovably in a longitudinal direction with respect to the switch.

24. The temperature-dependent switch of claim 20, wherein the bimetal part is formed as a rectangular spring, which is mounted at both its end faces immovably in a longitudinal direction with respect to the switch.

25. The temperature-dependent switch of claim 17, wherein the bimetal part is formed as a disc, which is mounted at its periphery immovably with respect to the switch.

26. The temperature-dependent switch of claim 22, wherein the bimetal part is formed as a disc, which is mounted at its periphery immovably with respect to the switch.

* * * * *